US011286947B2

(12) United States Patent
Horng et al.

(10) Patent No.: US 11,286,947 B2
(45) Date of Patent: Mar. 29, 2022

(54) IMPELLER AND COOLING FAN INCLUDING THE IMPELLER

(71) Applicant: Sunonwealth Electric Machine Industry Co., Ltd., Kaohsiung (TW)

(72) Inventors: Alex Horng, Kaohsiung (TW); Chien-Yuan Tseng, Kaohsiung (TW); Chi-Min Wang, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 16/801,405

(22) Filed: Feb. 26, 2020

(65) Prior Publication Data

US 2021/0190089 A1 Jun. 24, 2021

(51) Int. Cl.

| | |
|---|---|
| ***F04D 29/38*** | (2006.01) |
| ***F04D 19/00*** | (2006.01) |
| ***F04D 29/32*** | (2006.01) |
| ***F04D 29/34*** | (2006.01) |
| ***F04D 29/54*** | (2006.01) |
| ***F04D 29/66*** | (2006.01) |

(52) U.S. Cl.

CPC ..... *F04D 29/384* (2013.01); *F04D 19/002* (2013.01); *F04D 29/329* (2013.01); *F04D 29/34* (2013.01); *F04D 29/542* (2013.01); *F04D 29/666* (2013.01)

(58) Field of Classification Search

CPC .... F04D 29/384; F04D 29/002; F04D 29/329; F04D 29/34; F04D 29/542; F04D 29/666

See application file for complete search history.

(56) References Cited

U.S. PATENT DOCUMENTS

| | | | | |
|---|---|---|---|---|
| 5,829,956 | A * | 11/1998 | Chen | F04D 29/326 416/196 A |
| 7,722,311 | B2 | 5/2010 | Peterson et al. | |
| 8,556,587 | B2 * | 10/2013 | Suzuki | F04D 29/34 416/193 R |
| 9,140,266 | B2 | 9/2015 | Horng et al. | |
| 9,765,788 | B2 | 9/2017 | Dybenko et al. | |
| 10,001,128 | B2 | 6/2018 | Lin et al. | |
| 10,316,862 | B2 * | 6/2019 | You | F04D 29/5806 |
| 10,487,845 | B2 | 11/2019 | Yang et al. | |
| 10,677,258 | B2 * | 6/2020 | Tamaoka | F04D 29/162 |
| 10,738,787 | B2 | 8/2020 | Dybenko et al. | |
| 10,794,393 | B2 * | 10/2020 | Huang | F04D 25/0613 |
| 10,914,313 | B2 * | 2/2021 | Yu | F04D 29/666 |

(Continued)

FOREIGN PATENT DOCUMENTS

| | | |
|---|---|---|
| CN | 205805945 U | 12/2016 |
| CN | 107100889 A | 8/2017 |

(Continued)

*Primary Examiner* — Courtney D Heinle
*Assistant Examiner* — Ryan C Clark
(74) *Attorney, Agent, or Firm* — Karin L. Williams; Alan D. Kamrath; Mayer & Williams PC

(57) ABSTRACT

An impeller includes a hub, a plurality of blades provided around an outer periphery of the hub, and at least two connecting rings connected to the plurality of blades. Each of the plurality of blades has a top edge and a bottom edge opposite to the top edge. One or more of the at least two connecting rings is disposed between but not connected to the top edges and the bottom edges of the plurality of blades. A cooling fan including the impeller is also provided.

28 Claims, 9 Drawing Sheets

(56) References Cited

U.S. PATENT DOCUMENTS

| | | | | |
|---|---|---|---|---|
| 10,989,218 | B2 | 4/2021 | Xu et al. | |
| 2003/0012653 | A1* | 1/2003 | Diemunsch | F04D 29/023 416/193 R |
| 2008/0213103 | A1* | 9/2008 | Miyakoda | F04D 29/384 417/354 |
| 2009/0035126 | A1* | 2/2009 | Hwang | F04D 29/666 415/119 |
| 2014/0127022 | A1* | 5/2014 | Cheng | F04D 29/281 416/192 |
| 2015/0016958 | A1* | 1/2015 | Hofmann | F04D 29/056 415/55.5 |
| 2018/0219446 | A1* | 8/2018 | Yamada | F04D 29/329 |
| 2018/0252237 | A1* | 9/2018 | Lin | F04D 29/30 |
| 2019/0055958 | A1* | 2/2019 | Jia | F04D 29/325 |
| 2019/0128278 | A1* | 5/2019 | Chan | F04D 29/663 |
| 2019/0211843 | A1* | 7/2019 | Dygert | F04D 25/12 |
| 2020/0040910 | A1 | 2/2020 | Horler et al. | |

FOREIGN PATENT DOCUMENTS

| | | | |
|---|---|---|---|
| CN | 108612671 | A | 10/2018 |
| CN | 209569198 | U | 11/2019 |
| JP | H8326696 | A | 12/1996 |
| JP | H09222095 | A | 8/1997 |
| JP | 2010-511826 | A | 4/2010 |
| JP | 2012229689 | A | 11/2012 |
| KR | 20100123055 | A | 11/2010 |
| TW | 200903233 | A | 1/2009 |
| TW | M516103 | U | 1/2016 |
| WO | WO2018109480 | A1 | 6/2018 |

* cited by examiner

IMPELLER AND COOLING FAN INCLUDING THE IMPELLER

CROSS REFERENCE TO RELATED APPLICATION

The application claims the benefit of Taiwan application serial No. 108147421, filed on Dec. 24, 2019, and the subject matter of which is incorporated herein by reference.

BACKGROUND OF THE INVENTION

1. Field of the Invention

The present invention generally relates to an air-driving device and, more particularly, to an impeller and a cooling fan including the impeller.

2. Description of the Related Art

As thinness, lightness and high performance are required for the development of the electronic devices, miniaturization of the cooling fan is needed in addition to providing the electronic devices with the cooling function. The size of the cooling fan is usually reduced by reducing the thickness of the blades. However, this lowers the strength of the blades and adversely affects the stability of rotation. In light of this, another type of the cooling fan was proposed which includes a ring connected to one side of the blades. As such, the interconnection of the blades through the ring can improve the stability of the blades of the impeller. An example of such a cooling fan is seen in Taiwan Patent No. M516103.

However, although the blades are interconnected through the ring, the rotation of the impeller is still not sufficiently stable due to the reduced thickness and strength of the blades. In this regard, the blades tend to vibrate or even deform under the air resistance, which leads to larger vibration and noise and significantly affects the stability in operation of the fan.

In light of this, it is necessary to improve the conventional cooling fan.

SUMMARY OF THE INVENTION

It is therefore the objective of this invention to provide an impeller and a cooling fan including the impeller, in which the vibration of the impeller can be reduced during the rotation to thereby improve the stability of rotation and to reduce the noise.

It is another objective of this invention to provide an impeller and a cooling fan including the impeller which are capable of driving a larger volume of air.

It is a further objective of this invention to provide an impeller and a cooling fan including the impeller which have improved operational efficiency.

It is yet a further objective of this invention to provide an impeller and a cooling fan including the impeller which have a lower manufacturing cost.

As used herein, the term "one" or "an" for describing the number of the elements and members of the present invention is used for convenience, provides the general meaning of the scope of the present invention, and should be interpreted to include one or at least one. Furthermore, unless explicitly indicated otherwise, the concept of a single component also includes the case of plural components.

As used herein, the term "coupling", "join", "assembly" or the like is used to include separation of connected members without destroying the members after connection or inseparable connection of the members after connection. A person having ordinary skill in the art would be able to select the type of connection according to desired demands in the material or assembly of the members to be connected.

In an aspect, an impeller includes a hub, a plurality of blades provided around an outer periphery of the hub, and at least two connecting rings connected to the plurality of blades. Each of the plurality of blades has a top edge and a bottom edge opposite to the top edge. One or more of the at least two connecting rings is disposed between but not connected to the top edges and the bottom edges of the plurality of blades.

In another aspect, a cooling fan includes a fan frame, a stator and the impeller. The fan frame includes a base having a shaft tube. The stator is mounted around an outer periphery of the shaft tube. The impeller is rotatably coupled with the shaft tube.

Based on the above, in the impeller and the cooling fan including the impeller according to the invention, the at least two connecting rings can have a sufficient strength by having one or more of the at least two connecting rings disposed between but not connected to the top edges and the bottom edges of the plurality of blades. As such, the plurality of blades can be retained in place to reduce the vibration or deformation of the impeller caused by the plurality of blades suffering from the impact of the air resistance. Advantageously, the rotational stability of the plurality of blades and the performance of the cooling fan can be improved and the noise can be reduced.

In an example, the at least two connecting rings are at a same level. As such, the plurality of blades can be retained in place to improve the stability of the plurality of blades.

In the example, the at least two connecting rings are disposed in a middle between the top edges and the bottom edges of the plurality of blades. As such, the plurality of blades can be better secured, reducing the vibration of the plurality of blades under high-speed rotation.

In the example, the hub has an annular wall connected to a first end of each of the plurality of blades, and one of the at least two connecting rings is connected to a second end of each of the plurality of blades. As such, the structure is simple and allows for convenient manufacturing, thereby reducing the manufacturing cost of the impeller.

In the example, the annular wall includes an extension portion extending outwards radially and connecting to the first ends of the plurality of blades. As such, the extension portion can increase the contact area between the plurality of blades and the annular wall of the hub, improving the reliability in engagement between the hub and the plurality of blades.

In the example, each of the plurality of blades has a length between a first end and a second end thereof, and each of the at least two connecting rings is connected to each of the plurality of blades at any position from the second end to where it is at one-third of the length from the annular wall. As such, the plurality of blades can be better reinforced to further improve the stability of the plurality of blades.

In the example, each of the plurality of blades has a first end and a second end higher than the first end, and the first end is more adjacent to the hub than the second end is. As such, the plurality of blades is able to drive the air of larger volume.

In the example, a distance between the top edge and the bottom edge of the blade gradually increases from the first end to the second end of the blade. As such, the plurality of blades is able to drive the air of larger volume.

In the example, each of the plurality of blades includes a rear curving section and a front curving section. The rear curving section is more adjacent to the hub than the front curving section is. Each of the plurality of blades further includes an intermediate section connected between the rear curving section and the front curving section. One of the at least two connecting rings is disposed on the intermediate section. As such, the plurality of blades can be better reinforced to further improve the stability of the plurality of blades.

In the example, the at least two connecting rings include two connecting rings. One of the two connecting rings is disposed between but not connected to the top edges and the bottom edges of the plurality of blades. Another of the two connecting rings is connected to the plurality of blades slightly above or below the top edges of the plurality of blades, or slightly above or below the bottom edges of the plurality of blades. As such, the structure is simple and allows for convenient manufacturing, thereby reducing the manufacturing cost of the impeller.

In the example, the hub includes an annular wall connected to an edge of a plate. The plate has a central hole. The hub includes a reinforcing portion around the central hole of the plate. As such, the structure strength of the impeller is improved.

In the example, the reinforcing portion includes a plurality of protruding ribs extending from the central hole towards the annular wall of the hub. As such, the overall structure strength of the hub is improved.

In the example, the reinforcing portion includes an annular rib around the central hole of the hub. As such, the annular rib of the reinforcing portion can increase the structural strength of the plate around the central hole, thereby improving the structural strength of the hub.

In the example, the reinforcing portion further includes a plurality of protruding ribs extending from the annular rib towards the annular wall of the hub. As such, the overall structural strength of the hub is more effectively improved.

In the example, the at least two connecting rings include three connecting rings. One of the three connecting rings is disposed between but not connected to the top edges and the bottom edges of the plurality of blades, and another two of the three connecting rings are connected to the top edges and the bottom edges of the plurality of blades, respectively. This not only provides an alternative arrangement of the impeller but also further secures the plurality of blades in place through the use of the three connecting rings, thereby reducing the vibration or deformation of the impeller caused by the plurality of blades suffering from the impact of the air resistance.

In the example, the one of the three connecting rings is more adjacent to the hub than the other two of the three connecting rings are. As such, the structure is simple and allows for convenient manufacturing, thereby reducing the manufacturing cost of the impeller.

In the example, each of the plurality of blades has a thickness of 0.02 to 0.5 mm. As such, the cooling fan as a whole can remain in a slim fashion, preventing overweighting of the impeller and thereby improving the performance of the cooling fan.

In another example, each of the plurality of blades has a thickness smaller than 0.1 mm. As such, the cooling fan as a whole can remain in a slim fashion, preventing overweighting of the impeller and thereby improving the performance of the cooling fan.

In the example, a quantity of the plurality of blades is 70 to 134. As such, the plurality of blades that has a reduced thickness will be able to drive air of sufficient volume, thereby improving the air-driving effect of the impeller.

In another example, a quantity of the plurality of blades is 91 to 134. As such, the plurality of blades that has a reduced thickness will be able to drive air of sufficient volume, thereby improving the air-driving effect of the impeller.

In the example, an outer diameter of the impeller is larger than or equal to 40 mm. As such, the plurality of blades that has a reduced thickness will be able to drive air of sufficient volume, thereby improving the air-driving effect of the impeller.

In the example, the plurality of blades and the at least two connecting rings are made of polymer. As such, the structural strength of the plurality of blades and the two connecting rings is improved.

In the example, the polymer is a mixture of liquid crystal polymer and carbon fiber. As such, the material will have a better tensile strength and a heat resistance to allow for convenient manufacturing and to attain a higher structural strength.

In the example, the polymer is a mixture of liquid crystal polymer and mineral fiber. As such, the material will have a better tensile strength and a heat resistance to allow for convenient manufacturing and to attain a higher structural strength.

In the example, the polymer is a mixture of liquid crystal polymer, glass fiber and mineral fiber. As such, the material will have a better tensile strength and a heat resistance to allow for convenient manufacturing and to attain a higher structural strength.

In the example, the plurality of blades does not extend beyond a top face of the hub. As such, the axial height of the impeller can be reduced.

In the example, each of the at least two connecting rings has a thickness larger than or equal to a maximum thickness of each of the plurality of blades. As such, it can be ensured that the connecting rings have a sufficient strength to reinforce the plurality of blades, thus improving the stability of the plurality of blades.

In the example, each of the at least two connecting rings has a radial width larger than or equal to a maximum thickness of each of the plurality of blades. As such, it can be ensured that the connecting rings have a sufficient strength to reinforce the plurality of blades, thus improving the stability of the plurality of blades.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
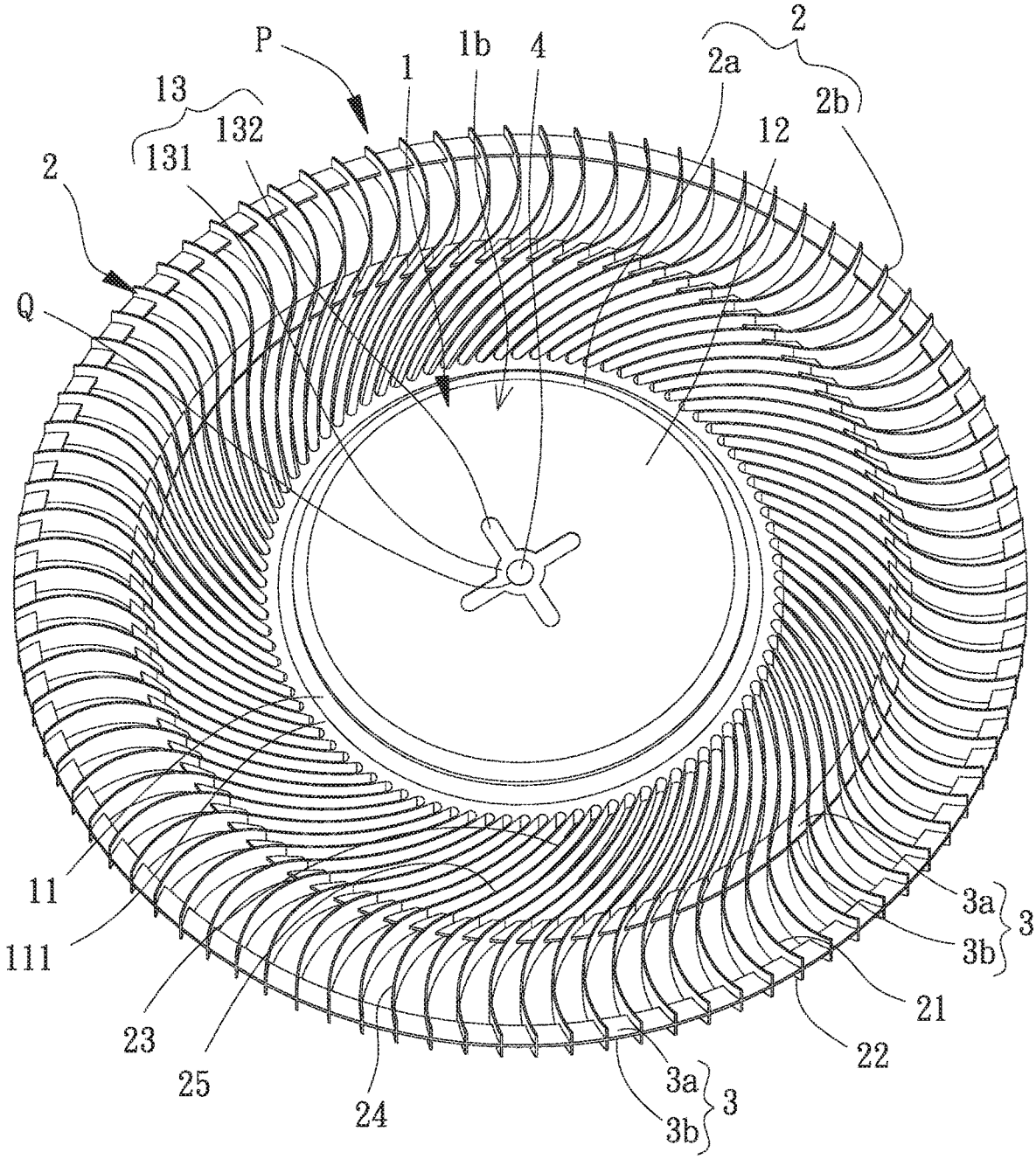
FIG. 1 is a perspective view of an impeller according to a first embodiment of the invention.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

FIG. 1 shows an impeller P according to a first embodiment of the invention. The impeller P includes a hub 1, a plurality of blades 2 coupled with the outer periphery of the hub 1, and at least two connecting rings 3 connected to the plurality of blades 2. The impeller P according to the invention can be used to form a centrifugal fan or a cross-flow fan. The following description is made with the centrifugal fan, but it is not intended to limit the invention.

A shaft 4 can be arranged at the center of the hub 1, which can be readily appreciated by one of ordinary skill and therefore it is not described herein for brevity. The hub 1 includes an annular wall 11 connected to the edge of a plate 12. The plate 12 has a central hole Q. The annular wall 11 can be coupled with the plurality of blades 2. In this embodiment, the annular wall 11 includes an extension portion 111 that may be integrally formed with the annular wall 11. The extension portion 111 may be located between the at least two connecting rings 3 and the annular wall 11. The extension portion 111 is not connected to the at least two connecting rings 3 but extends radially outward from the annular wall 11 (away from the shaft 4) to connect with the plurality of blades 2. For example, the extension portion 111 is made of plastic material and forms along the outer periphery of the annular wall 11. Thus, when the reduction in thickness of the plurality of blades 2 is required, the extension portion 111 can increase the contact area between the plurality of blades 2 and the annular wall 11 of the hub 1. Advantageously, the plurality of blades 2 can be more securely coupled with the hub 1 without breaking easily.

Besides, the hub 1 has an inner face 1*a* (shown in FIG. 4) and an outer face 1*b* opposite to the inner face 1*a*. The hub 1 includes a reinforcing portion 13 around the central hole Q. The reinforcing portion 13 is configured to improve the structural strength of the hub 1. In this embodiment, the reinforcing portion 13 provided on the inner face 1*a* of the hub 1 for illustration purpose. Specifically, the reinforcing portion 13 includes an annular rib 131 around the central hole Q. The annular rib 131 can increase the structural strength of the plate 12 around the central hole Q. The reinforcing portion 13 can further include a plurality of protruding ribs 132 connecting to the annular rib 131 and extending towards the annular wall 11. As a preferred case of this arrangement, the plurality of protruding ribs 132 extends radially from the central hole Q, further improving the structural strength of the hub 1.

Figure 2:
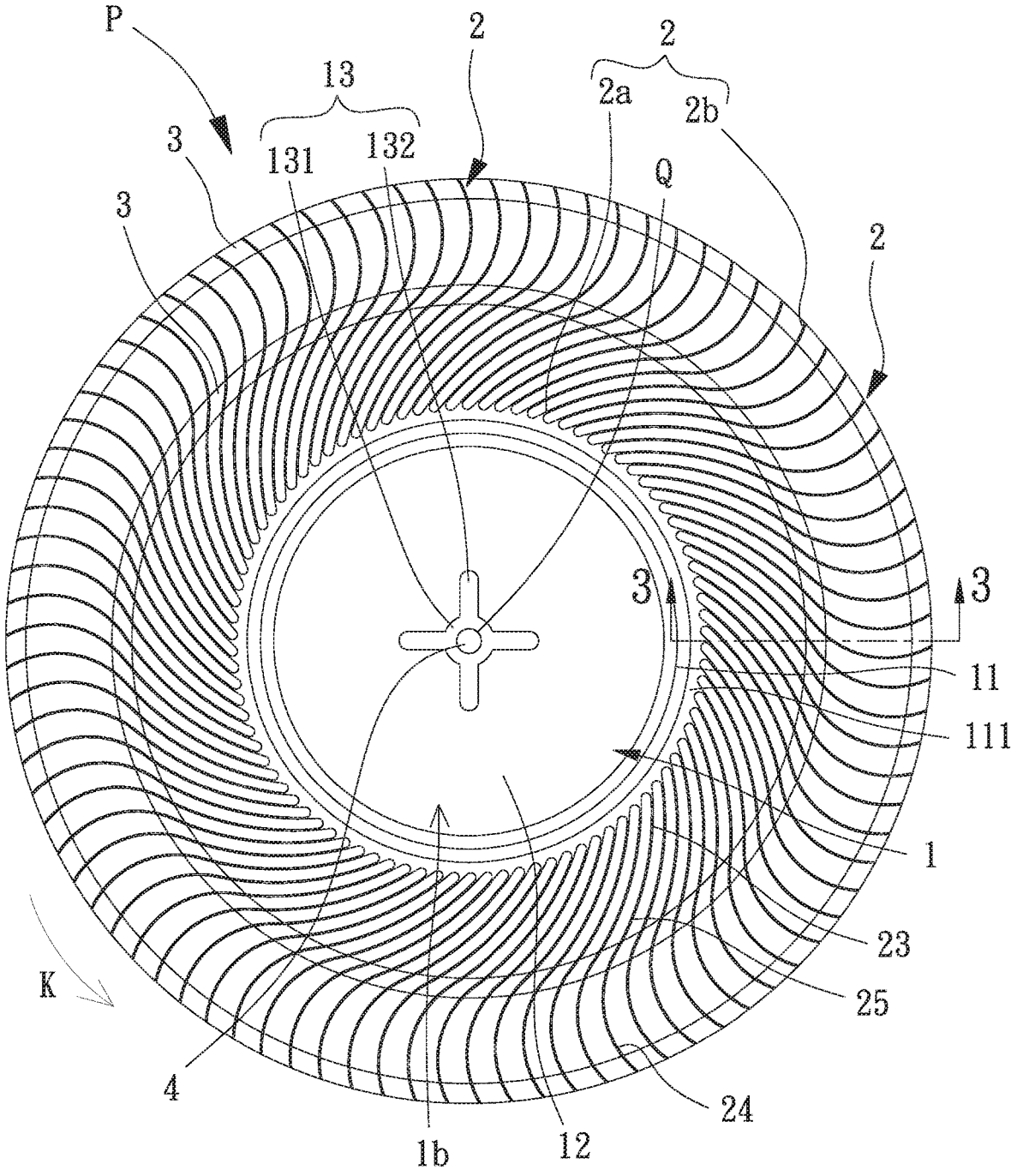
FIG. 2 is a top view of the impeller of FIG. 1.
Figure 3:
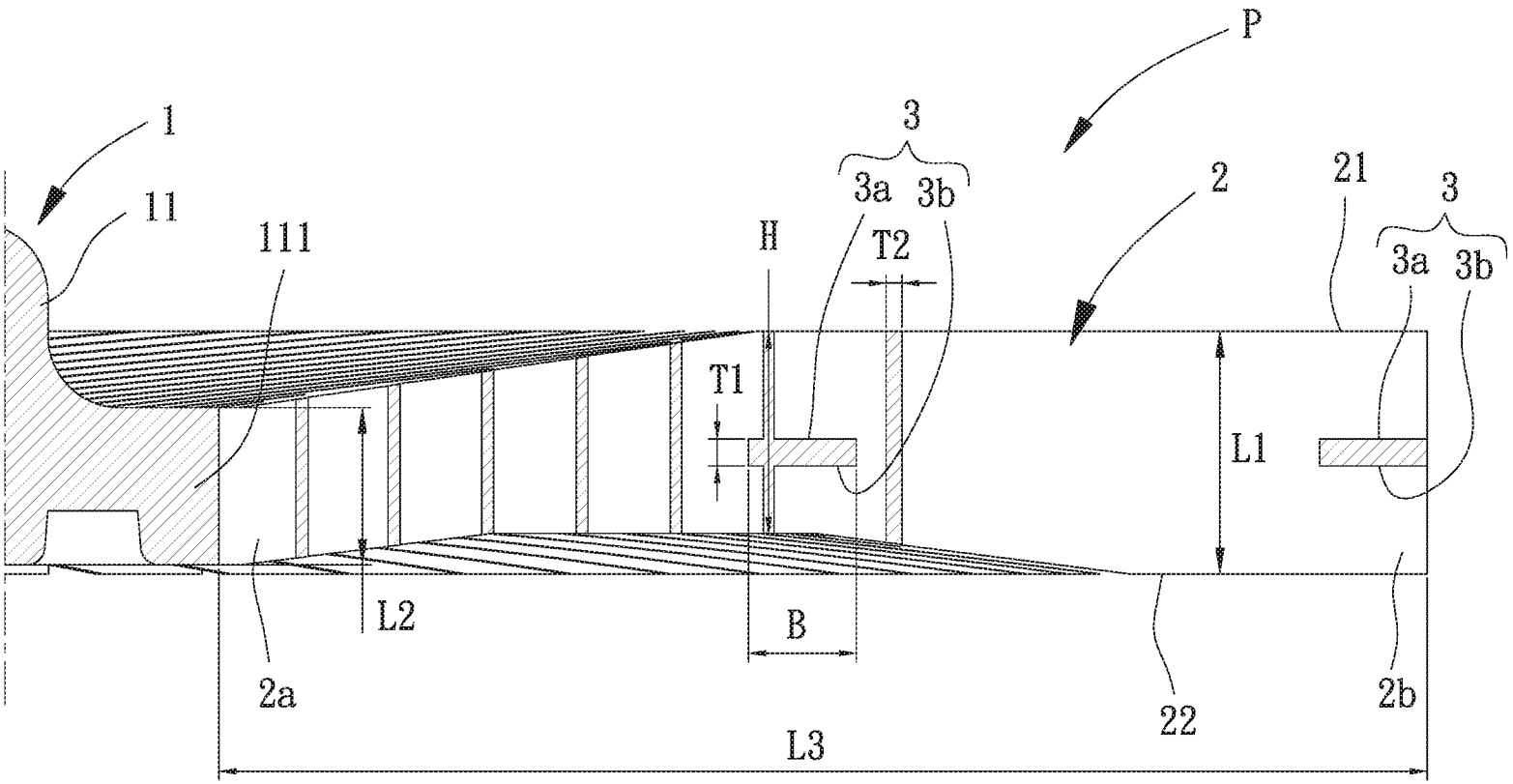
FIG. 3 is a cross sectional view of the impeller taken along line 3-3 of FIG. 2.

Referring to FIGS. 2 and 3, the plurality of blades 2 preferably does not extend beyond the top face of the hub 1 to reduce the thickness of the impeller P. Each of the plurality of blades 2 includes a first end 2*a* connected to the extension portion 111 of the annular wall 11, as well as a second end 2*b* opposite to the first end 2*a* and having a height L1 larger than a height L2 of the first end 2*a*. The material of the plurality of blades 2 is not limited. Each of the plurality of blades 2 can be connected to the annular wall 11 by ways of fastening, adhesion or integral formation, which is not taken in a limited sense in the invention. For example, when the annular wall 11 and the plurality of blades 2 are made of the same material, integral formation can be used to improve the structural strength and production efficiency. In this embodiment, the annular wall 11, the plurality of blades 2 and the at least two connecting rings 3 are made of polymer and are connected to the hub 1 by injection molding. The polymer is preferably the mixture of liquid crystal polymer and carbon fiber, the mixture of liquid crystal polymer and mineral fiber, or the mixture of liquid crystal polymer, glass fiber and mineral fiber. Alternatively, the metal powder of iron, aluminum, copper or alloy can be mixed with polymer adhesive to form the impeller P through injection molding of the mixture. This approach also improves the structural strength of the impeller P.

Referring to FIGS. 1 and 3, each of the plurality of blades 2 has a top edge 21 and a bottom edge 22 opposite to the top edge 21. The distance between the top edge 21 and the bottom edge 22 gradually increases from the first end 2*a* to the second end 2*b* as shown in FIG. 3, enabling the plurality of blades 2 to drive a larger volume of air. The height L2 of the second end 2*b* of the blade 2 may be 1-6 mm, and is preferably 1.7-4.7 mm. The thickness of the blade 2 may be 0.02-0.5 mm, with 0.1 mm preferred. This remains the fan in a slim fashion and prevents the overweighting of the impeller P, advantageously improving the operational efficiency thereof. The quantity of the plurality of blades 2 can be 70-134, and is preferably 91-134. The outer diameter of the impeller P can be larger than or equal to 40 mm, such that the slim blades 2 can drive air of sufficient volume and can be disposed around the hub 1.

Referring to FIG. 3, the connecting ring 3 has a thickness T1 which is preferably larger than or equal to the maximum thickness T2 of the blade 2 and is smaller than a quarter of the maximum height H of the blade 2 connecting to the connecting ring 3. Furthermore, the radial width B of the connecting ring 3 is preferably larger than or equal to the maximum thickness T2 of the blade 2, and is smaller than or equal to one sixth of the length L3 of the blade 2. In this arrangement, it can be ensured that the connecting ring 3 has a sufficient strength to reinforce the plurality of blades 2, thereby improving the stability of the plurality of blades 2.

Referring to FIGS. 1 and 2, it is particularly noted that the first end 2*a* and the second end 2*b* of the blade 2 can align with each other in the same radial direction. In other words, the line passing through the first end 2*a* and the second end 2*b* of the blade 2 can pass through the center of the hub 1, such that the plurality of blades 2 can be connected to the hub 1 in a radial fashion. Alternatively, the line passing through the first end 2*a* and the second end 2*b* of the blade 2 does not pass through the center of the hub 1, such that each of the plurality of blades 2 is tangential to the annular wall 11 of the hub 1. The invention is limited to either implementation. In this embodiment, each of the plurality of blades 2 includes a rear curving section 23 relatively adjacent to the hub 1, as well as a front curving section 24 relatively distant to the hub 1. The front curving section 24 curves in the same direction as the rotating direction K of the impeller P, whereas the rear curving section 23 curves in the opposite direction to the rotating direction K of the impeller P. Both the rear curving section 23 and the front curving section 24 can be in an arched form as shown in the drawing. Each of the plurality of blades 2 may further include an intermediate section 25 connected between the rear curving section 23 and the front curving section 24.

Referring to FIGS. 2 and 3, the at least two connecting rings 3 are connected to any portions of the blade 2 between the first end 2*a* and the second end 2*b*, but are not connected to the extension portion 111. For example, one of the at least two connecting rings 3 is connected to the middle of the blade 2 half of the length L3 from either end of the blade 2, or is connected to the rear curving section 23 or the front curving section 24. Preferably, each of the at least two connecting rings 3 is connected to the blade 2 at any position from the second end 2*b* to where it is at one-third of the length L3 from the annular wall 11. Alternatively, one of the at least two connecting rings 3 is connected to the blade 2 at any position from the second end 2*b* to where it is at one-third of the length L3 from the annular wall 11, and the other connecting ring 3 is directly connected to the intermediate section 25 to better reinforce the plurality of blades 2. As such, the stability of the plurality of blades 2 is improved, and therefore the vibration of the plurality of blades 2 under high-speed rotation is reduced.

Specifically, each of the at least two connecting rings 3 includes a first face 3*a* and a second face 3*b* opposite to the first face 3*a*. The first face 3*a* faces the top edge 21 of the blade 2 and the second face 3*b* faces the bottom edge 22 of the blade 2. At least one of the at least two connecting rings 3 is connected between the top edges 21 and the bottom edges 22 of the blade 2. In this regard, the first face 3*a* of said at least one connecting ring 3 is not connected to the top edges 21 of the blades 2, and the second face 3*b* of said at least one connecting ring 3 is not connected to the bottom edges 22 of the blades 2.

Specifically, as an example of the at least two connecting rings 3 including two connecting rings 3, one of the two connecting rings 3 is disposed between but not connected to the top edges 21 and the bottom edges 22 of the blades 2, and another of the two connecting rings 3 is disposed on any other portion of the blade 2 such as the top edges 21 or the bottom edges 22 of the blades 2 (not limited). In this embodiment, both the two connecting rings 3 are disposed between but not connected to the top edges 21 and the bottom edges 22 of the blades 2 to enhance the stability of the blades 2. Preferably, the two connecting rings 3 are in the same level as shown in FIG. 3.

Besides, in this embodiment, the first face 3*a* of each connecting ring 3 is equally spaced from the top edge 21 as the second face 3*b* is spaced from the bottom edge 22, such that each connecting ring 3 is disposed in the middle of the blade 2 having an equal distance from the top edge 21 and the bottom edge 22 of the blade 2. In such an arrangement, a better reinforcement effect can be provided to improve the stability of the plurality of blades 2, further securing the plurality of blades 2 and reducing the vibration of the plurality of blades 2 under high-speed rotation.

Figure 4:
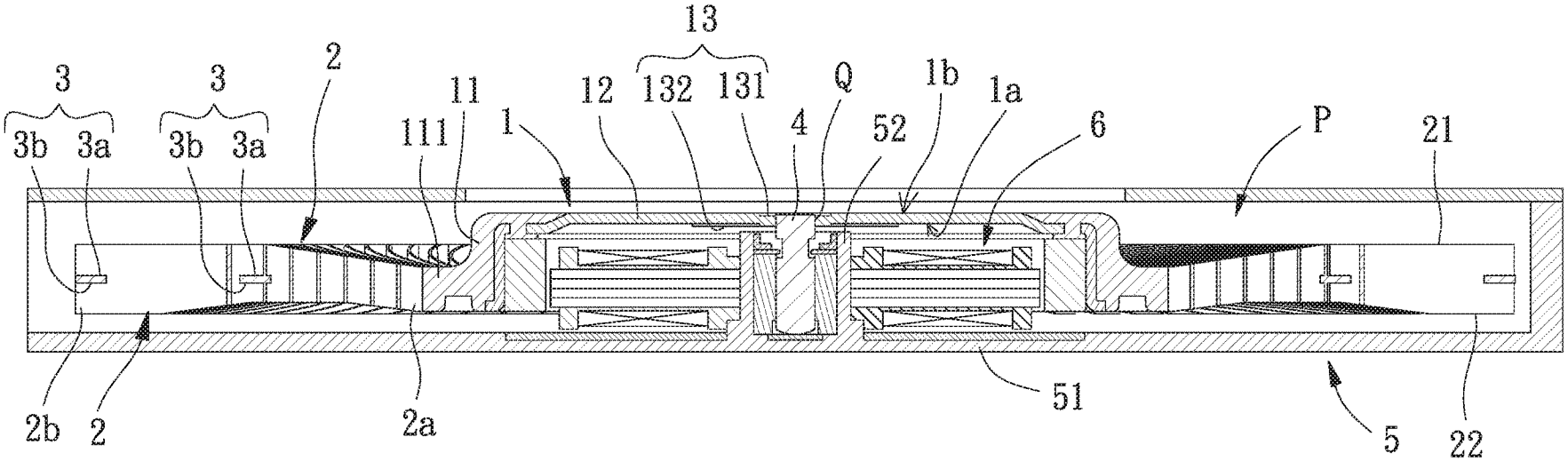
FIG. 4 is a cross sectional view of a cooling fan including the impeller of the first embodiment of the invention.

Referring to FIGS. 3 and 4, based on the above structure, a cooling fan having the impeller P according to the embodiment of the invention includes a fan frame 5. The fan frame 5 includes a base 51 having a shaft tube 52 into which the shaft 4, that is connected to the impeller P, is inserted. A stator 6 is fit around the outer periphery of the shaft tube 52. Since the two connecting rings 3 are connected between the top edges 21 and the bottom edges 22 of the plurality of blades 2 without having their first faces 3*a* connected to the top edges 21 and having their second faces 3*b* connected to the bottom edges 22, the two connecting rings 3 will have a sufficient strength to secure the plurality of blades 2 in place. This reduces the vibration or deformation of the impeller P caused by the blades 2 suffering from the impact of the air resistance, thus improving the overall stability of the blades 2 including its rotational stability and advantageously reducing the noise.

Figure 5A:
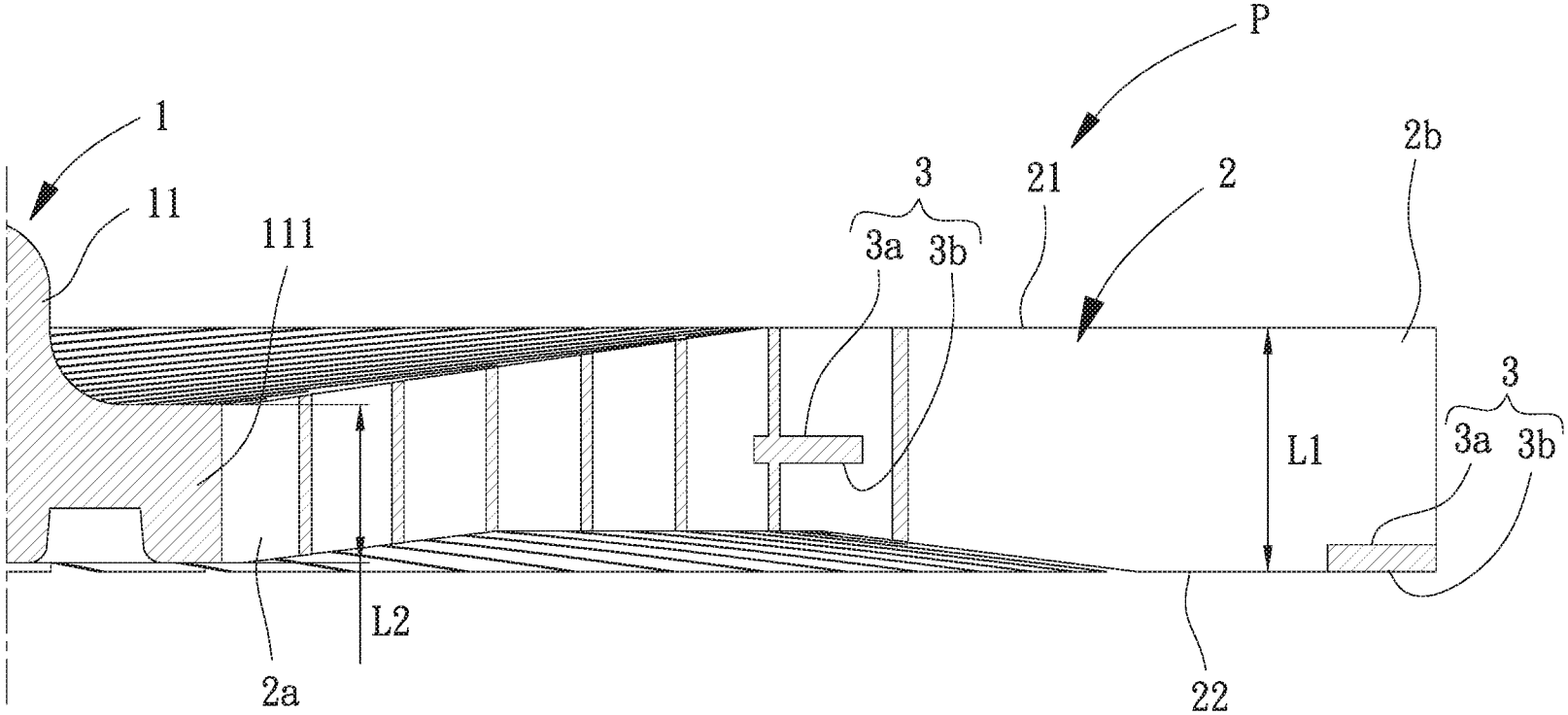
FIG. 5*a* is a partial, cross sectional view of an impeller according to a second embodiment of the invention.

Referring to FIG. 5*a* showing an impeller P according to a second embodiment of the invention. One of the two connecting rings 3 is disposed between but not connected to the top edges 21 and the bottom edges 22 of the plurality of blades 2 and is relatively adjacent to the hub 1, whereas the other connecting ring 3 is relatively distant to the hub 1 and is disposed at the second ends 2*b* of the plurality of blades 2 and is connected to the bottom edges 22 of the plurality of blades 2. The other connecting ring 3 can be connected to the plurality of blades 2 slightly above or below the bottom edges 22 of the plurality of blades 2 as shown in FIG. 5*a*. For example, the other connecting ring 3 can be flush with the bottom edges 22 of the plurality of blades 2 without protruding beyond said bottom edges 22, or can partially or completely protrude beyond the bottom edges 22 of the plurality of blades 2. In this embodiment, the other connecting ring 3 is flush with the bottom edges 22 of the plurality of blades 2 without protruding beyond said bottom edges 22; namely, the second face 3*b* of the other connecting ring 3 is connected to the bottom edges 22 of the plurality of blades 2 as an alternative arrangement of the impeller P.

Figure 5B:
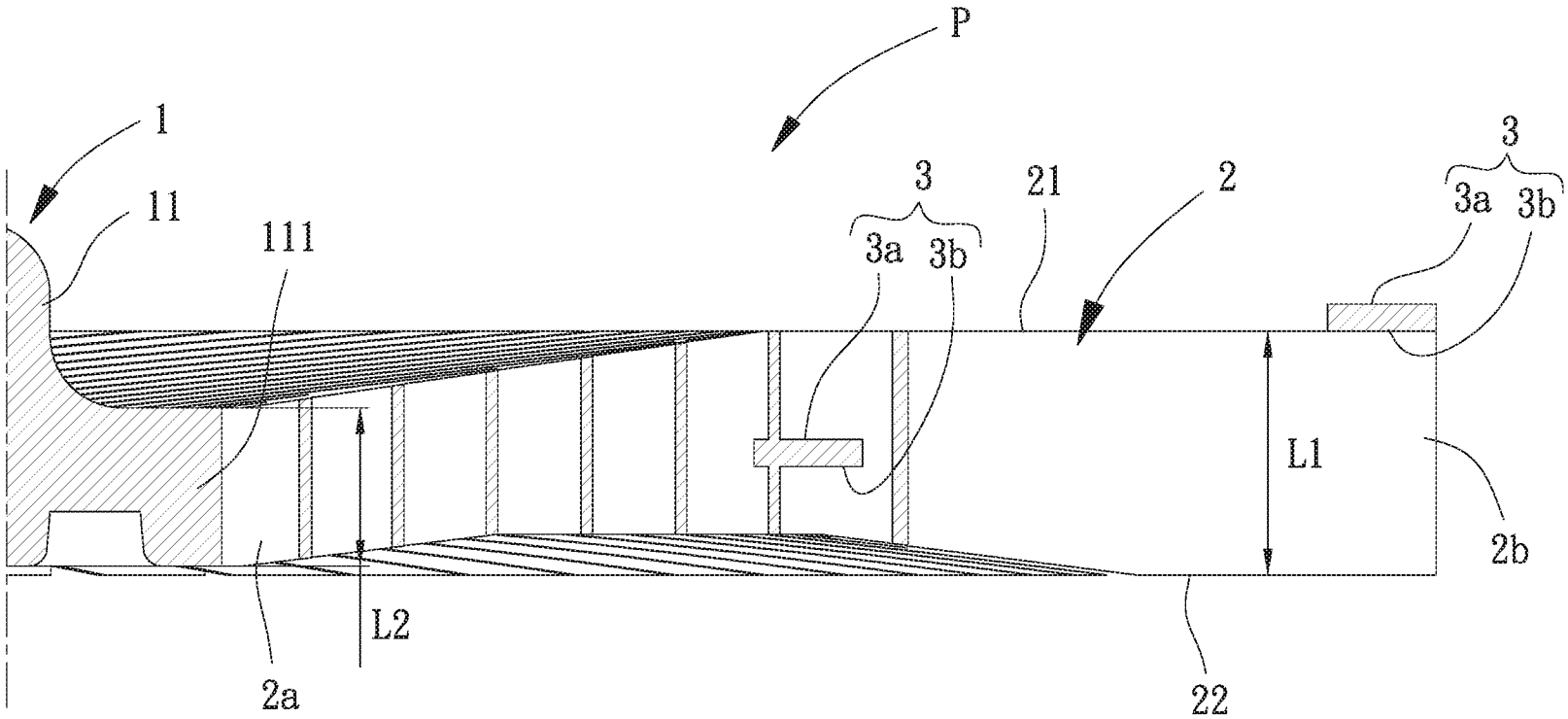
FIG. 5*b* is a partial, cross sectional view of an impeller according to another implementation of the second embodiment of the invention.

Besides, the other connecting ring 3 can also be connected to the plurality of blades 2 slightly above or below the top edges 21 of the plurality of blades 2. For example, the other connecting ring 3 can be flush with the top edges 21 of the plurality of blades 2 without protruding beyond said top edges 21, or can partially or completely protrude beyond the top edges 21 of the plurality of blades 2. In this embodiment, the other connecting ring 3 can extend completely beyond the top edges 21 of the plurality of blades 2 as shown in FIG. 5*b*; namely, the second face 3*b* of the other connecting ring 3 is connected to the top edges 21 of the plurality of blades 2 in a manner that the second face 3*b* of the other connecting ring 3 is flush with the top edges 21 of the plurality of blades 2. This provides another alternative arrangement of the impeller P.

Figure 6:
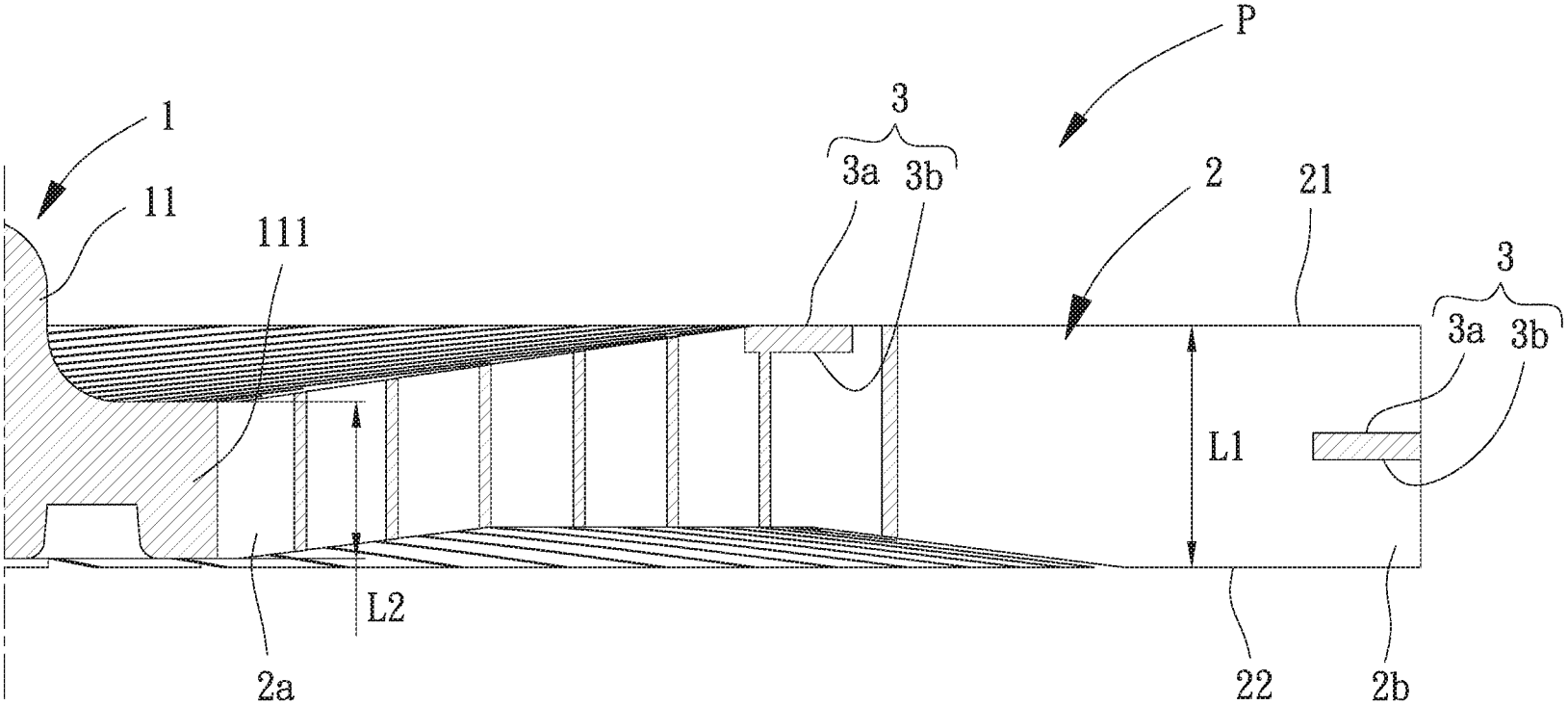
FIG. 6 is a partial, cross sectional view of an impeller according to a third embodiment of the invention.

Referring to FIG. 6 showing an impeller P according to a third embodiment of the invention. One of the two connecting rings 3 is disposed between but not connected to the top edges 21 and the bottom edges 22 of the plurality of blades 2 and is relatively distant to the hub 1 and is disposed at the second ends 2*b* of the plurality of blades 2, whereas the other connecting ring 3 is relatively adjacent to the hub 1 and is connected to the plurality of blades 2 slightly above or below the top edges 21 of the plurality of blades 2. For example, the other connecting ring 3 can be flush with the top edges 21 of the plurality of blades 2 without protruding beyond said top edges 21, or can partially or completely protrude beyond the top edges 21 of the plurality of blades 2. In this embodiment, the other connecting ring 3 is flush with the top edges 21 of the plurality of blades 2 without protruding beyond said top edges 21; namely, the first face 3*a* of the other connecting ring 3 is connected to the top edges 21 of the plurality of blades 2, ensuring that the other connecting ring 3 has larger contact areas with the plurality of blades 2. This reduces the vibration of the blades 2 resulting from the air resistance, thus providing a further alternative arrangement of the impeller P.

Figure 7:
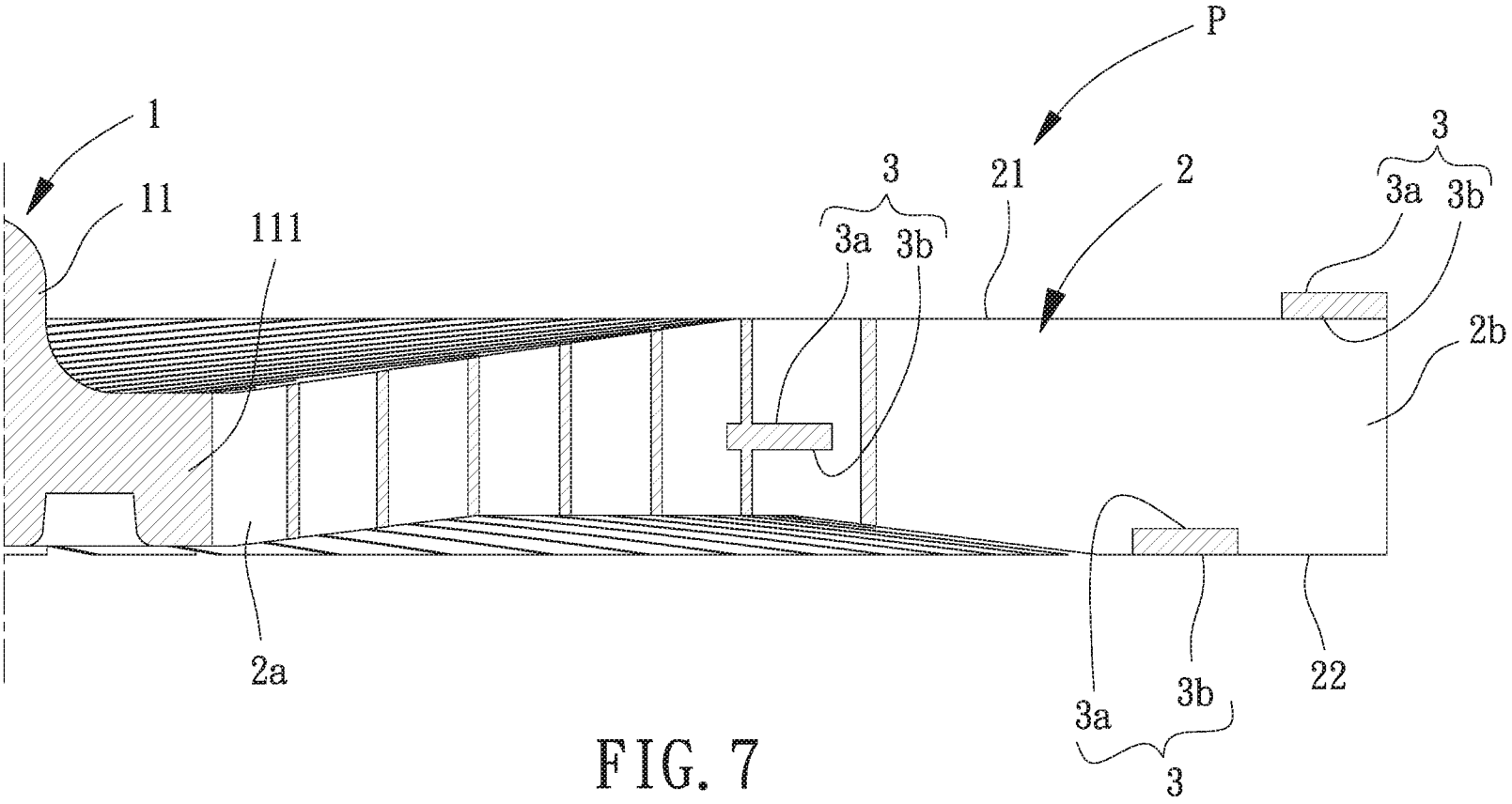
FIG. 7 is a partial, cross sectional view of an impeller according to a fourth embodiment of the invention.

Referring to FIG. 7 showing an impeller P according to a fourth embodiment of the invention where the quantity of the at least two connecting rings 3 is three. One of the three connecting rings 3 is disposed between but not connected to the top edges 21 and the bottom edges 22 of the plurality of blades 2 and is relatively adjacent to the hub 1, whereas the other two connecting rings 3 are relatively distant to the hub 1 and are preferably staggered and are respectively connected to top edges 21 and the bottom edges 22 of the plurality of blades 2. Among the other two connecting rings 3, one connecting ring 3 can be connected to the plurality of blades 2 slightly above or below the top edges 21 of the plurality of blades 2, and the other connecting ring 3 can be connected to the plurality of blades 2 slightly above or below the bottom edges 22 of the plurality of blades 2 as shown in FIG. 7. For example, one connecting ring 3 can be flush with the top edges 21 of the plurality of blades 2 without protruding beyond said top edges 21, or can partially or completely protrude beyond the top edges 21 of the plurality of blades 2. In this regard, the other connecting ring 3 can be flush with the bottom edges 22 of the plurality of blades 2 without protruding beyond said bottom edges 22, or can partially or completely protrude beyond the bottom edges 22 of the plurality of blades 2. In this embodiment, one connecting ring 3 among the other two connecting rings 3 completely protrudes beyond the top edges 21 of the plurality of blades 2, and the other connecting ring 3 is flush with the bottom edges 22 of the plurality of blades 2 without protruding beyond said bottom edges 22 to thereby reduce the height of the impeller. This provides yet a further alternative arrangement of the impeller P where the three connecting rings 3 can even better secure the plurality of blades 2 in place, thereby reducing the vibration or deformation of the impeller P caused by the plurality of blades 2 suffering from the impact of the air resistance.

Figure 8:
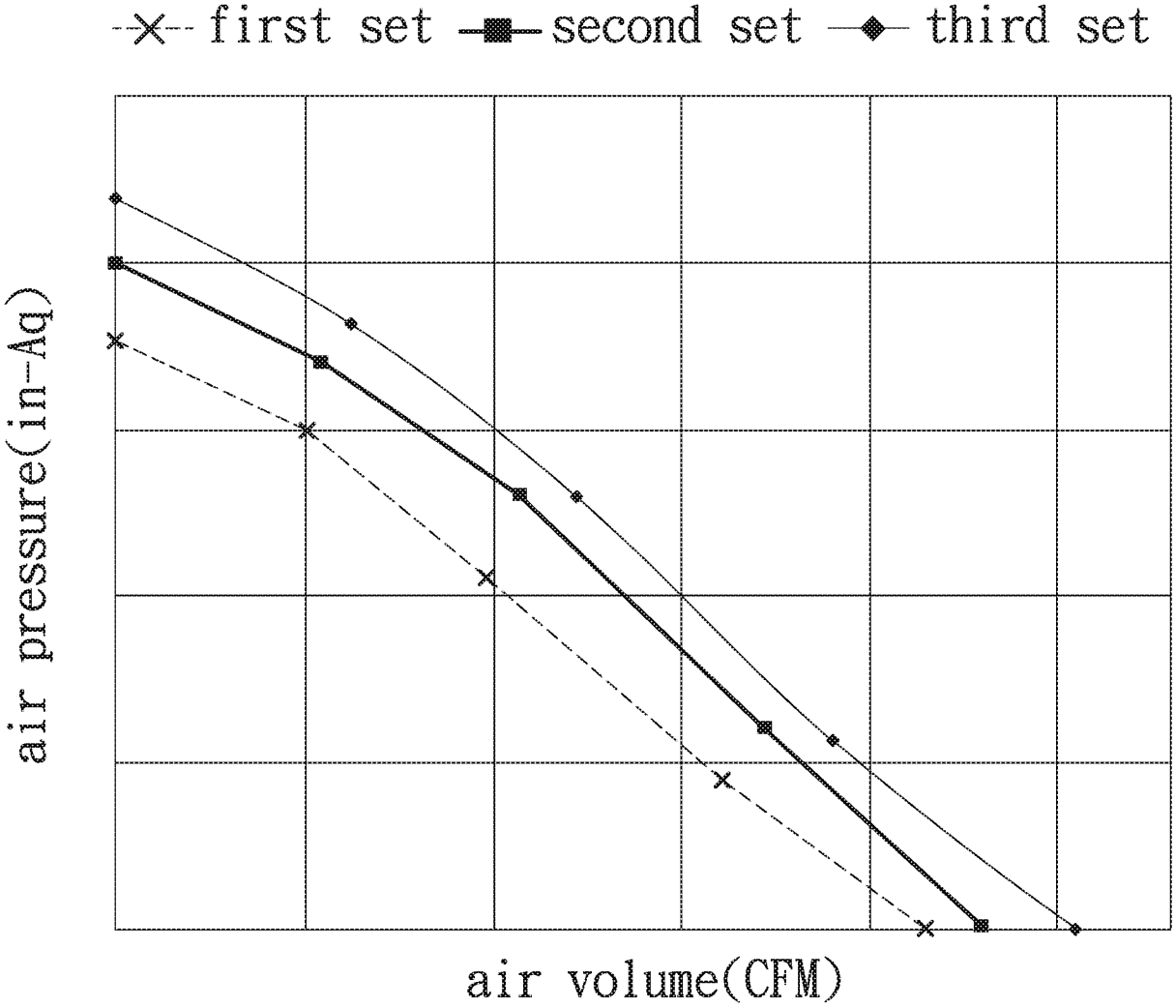
FIG. 8 shows three sets of air volume test results of a cooling fan under 1 atm for different arrangements of two connecting rings of the impeller of the invention.

FIG. 8 shows three sets of air volume test results of the cooling fan under 1 atm for different arrangements of the two connecting rings 3 of the impeller P according to the invention. The first set of test results is obtained by having both the connecting rings 3 disposed at the top edges 21 of the plurality of blades 2 (a conventional arrangement not described in the background art). The second set of test results is obtained by having one of the two connecting rings 3, which is relatively adjacent to the hub 1, disposed between the top edges 21 and the bottom edges 22 of the plurality of blades 2, as well as having the other connecting ring 3, which is relatively distant to the hub 1, disposed at the top edges 21 of the plurality of blades 2, as is described in the second embodiment of the invention. The third set of test results is obtained by having both the connecting rings 3 disposed between the top edges 21 and the bottom edges 22 of the plurality of blades 2, as is described in the first embodiment of the invention. These test results show the relationship between the air volume and the air pressure generated during the rotation of the impeller P under the same noise level, as shown in FIG. 8.

It can be seen from FIG. 8 that among the three sets of test results, the arrangements of the impeller P corresponding to the second and third sets of test results can generate larger air volumes and air pressures as compared with the arrangement of the first set of test result. Therefore, it is proven that the impeller P according to the invention can reinforce the plurality of blades 2 and increase the air volume and air pressure.

In summary, in the impeller and the cooling fan including the impeller according to the invention, the at least two connecting rings can have a sufficient strength by having one or more of the at least two connecting rings disposed between but not connected to the top edges and the bottom edges of the plurality of blades. As such, the plurality of blades can be retained in place to reduce the vibration or deformation of the impeller caused by the plurality of blades suffering from the impact of the air resistance. Advantageously, the rotational stability of the plurality of blades and the performance of the cooling fan can be improved and the noise can be reduced.

Although the invention has been described in detail with reference to its presently preferable embodiments, it will be understood by one of ordinary skill in the art that various modifications can be made without departing from the spirit and the scope of the invention, as set forth in the appended claims

What is claimed is:

1. A impeller comprising:

a hub;

a plurality of blades provided around an outer periphery of the hub, wherein each of the plurality of blades has a top edge and a bottom edge opposite to the top edge, wherein each of the plurality of blades includes a rear curving section and a front curving section, wherein the rear curving section is more adjacent to the hub than the front curving section is, wherein each of the plurality of blades further includes an intermediate section connected between the rear curving section and the front curving section; and at least two connecting rings connected to the plurality of blades, wherein one or more of the at least two connecting rings is disposed between but not connected to the top edges and the bottom edges of the plurality of blades, wherein one of the at least two connecting rings is disposed on the intermediate section.

2. The impeller as claimed in claim 1, wherein the at least two connecting rings are at a same level.

3. The impeller as claimed in claim 2, wherein the at least two connecting rings are disposed in a middle between the top edges and the bottom edges of the plurality of blades.

4. The impeller as claimed in claim 1, wherein the hub has an annular wall connected to a first end of each of the plurality of blades, and wherein one of the at least two connecting rings is connected to a second end of each of the plurality of blades.

5. The impeller as claimed in claim 4, wherein the annular wall includes an extension portion extending outwards radially and connecting to the first ends of the plurality of blades.

6. The impeller as claimed in claim 1, wherein each of the plurality of blades has a length between a first end and a second end thereof, and wherein each of the at least two connecting rings is connected to each of the plurality of blades at any position from the second end to where it is at one-third of the length from an annular wall.

7. The impeller as claimed in claim 1, wherein each of the plurality of blades has a first end and a second end higher than the first end, and wherein the first end is more adjacent to the hub than the second end is.

8. The impeller as claimed in claim 7, wherein a distance between the top edge and the bottom edge of the blade gradually increases from the first end to the second end of the blade.

9. The impeller as claimed in claim 1, wherein the at least two connecting rings include two connecting rings, wherein one of the two connecting rings is disposed between but not connected to the top edges and the bottom edges of the plurality of blades, and wherein another of the two connecting rings is connected to the plurality of blades above or below the top edges of the plurality of blades or above or below the bottom edges of the plurality of blades.

10. The impeller as claimed in claim 1, wherein the hub includes an annular wall connected to an edge of a plate, wherein the plate has a central hole, and wherein the hub includes a reinforcing portion around the central hole of the plate.

11. The impeller as claimed in claim 10, wherein the reinforcing portion includes a plurality of protruding ribs extending from the central hole towards the annular wall of the hub.

12. The impeller as claimed in claim 10, wherein the reinforcing portion includes an annular rib around the central hole of the hub.

13. The impeller as claimed in claim 12, wherein the reinforcing portion further includes a plurality of protruding ribs extending from the annular rib towards the annular wall of the hub.

14. The impeller as claimed in claim 1, wherein the at least two connecting rings include three connecting rings, wherein one of the three connecting rings is disposed between but not connected to the top edges and the bottom edges of the plurality of blades, and wherein another two of the three connecting rings are connected to the top edges and the bottom edges of the plurality of blades, respectively.

15. The impeller as claimed in claim 14, wherein the one of the three connecting rings is more adjacent to the hub than the other two of the three connecting rings are.

16. The impeller as claimed in claim 1, wherein each of the plurality of blades has a thickness of 0.02 to 0.5 mm.

17. The impeller as claimed in claim 16, wherein each of the plurality of blades has a thickness smaller than 0.1 mm.

18. The impeller as claimed in claim 1, wherein a quantity of the plurality of blades is 70 to 134.

19. The impeller as claimed in claim 18, wherein a quantity of the plurality of blades is 91 to 134.

20. The impeller as claimed in claim 1, wherein an outer diameter of the impeller is larger than or equal to 40 mm.

21. The impeller as claimed in claim 1, wherein the plurality of blades and the at least two connecting rings are made of polymer.

22. The impeller as claimed in claim 21, wherein the polymer is a mixture of liquid crystal polymer and carbon fiber.

23. The impeller as claimed in claim 21, wherein the polymer is a mixture of liquid crystal polymer and mineral fiber.

24. The impeller as claimed in claim 21, wherein the polymer is a mixture of liquid crystal polymer, glass fiber and mineral fiber.

25. The impeller as claimed in claim 1, wherein the plurality of blades does not extend beyond a top face of the hub.

26. The impeller as claimed in claim 1, wherein each of the at least two connecting rings has a thickness larger than or equal to a maximum thickness of each of the plurality of blades.

27. The impeller as claimed in claim 1, wherein each of the at least two connecting rings has a radial width larger than or equal to a maximum thickness of each of the plurality of blades.

28. A cooling fan comprising:

a fan frame including a base, wherein the base includes a shaft tube;

a stator mounted around an outer periphery of the shaft tube; and the impeller as claimed in claim 1, wherein the impeller is rotatably coupled with the shaft tube.

* * * * *